United States Patent [19]

DeBolt

[11] Patent Number: 4,470,383

[45] Date of Patent: Sep. 11, 1984

[54] VALVE SPRING DAMPER

[75] Inventor: Richard R. DeBolt, Metamora, Mich.

[73] Assignee: General Motors Corporation, Detroit, Mich.

[21] Appl. No.: 516,682

[22] Filed: Jul. 25, 1983

[51] Int. Cl.[3] ..... F01L 1/00

[52] U.S. Cl. ..... 123/90.65; 123/188 SC

[58] Field of Search ..... 123/90.65, 90.66, 90.67, 123/188 SA, 188 SC; 267/166, 167, 169; 251/322

[56] References Cited

U.S. PATENT DOCUMENTS 1,191,658 7/1916 Brown ..... 123/90.65 X 1,327,539 1/1920 Finney ..... 123/90.67 X 1,331,826 2/1920 Shepherd ..... 123/90.66 X

*Primary Examiner*—Michael Koczo

*Assistant Examiner*—Peggy A. Neils

*Attorney, Agent, or Firm*—Arthur N. Krein

[57] ABSTRACT

A valve spring damper has a split ring, to frictionally engage the coils of the valve return spring for a valve, and integral radial extending load carrying feet against which one end of the return spring abuts, the surface of each foot opposite the spring being provided with a semi-spherical embossment in order for the feet to accommodate to a support surface that may be normal or inclined relative to the reciprocating axis of the poppet valve.

2 Claims, 4 Drawing Figures

VALVE SPRING DAMPER

FIELD OF THE INVENTION

This invention relates to a poppet valve mechanism for use in an internal combustion engine and the like and, in particular, to a damper for eliminating surge of a valve return spring associated with a poppet valve.

DESCRIPTION OF THE PRIOR ART

The valve operating mechanism, as normally used in internal combustion engines and the like, includes a coil spring located concentric with an associate valve to resiliently oppose opening of the valve by a valve rocker or other actuator. Accordingly, the coil spring is operatively located so as to normally bias the poppet valve to its valve closed position, thus the term "valve return spring", is used to describe this spring.

With opposite ends of the coil valve return spring thus located to abut a retainer on the valve and the cylinder head, either directly or, for example, with a valve rotator sandwiched therebetween, respectively, the inherent twisting effect of the valve return spring, as it is flexed during valve reciprocation, causes the poppet valve to rotate in one direction during valve opening and in the opposite direction during valve closing. Various means have been proposed and used to control the transmission of this rotative force from the valve return spring to the poppet valve (normally an exhaust valve) during its reciprocation in order to effect an intermittent progressive rotation of the valve in one direction.

Such valve operating mechanism also normally includes a device for dampening spring surge; such device being operative so as to eliminate the inception of induced sympathetic vibrations of the spring during rapid flexing thereof by means of friction applied to the spring. The spring damper device can be of an internal type as shown, for example, in U.S. Pat. No. 3,336,913, entitled Valve Stem Seal, issued Aug. 22, 1967 to Harold E. McCormick or it can be of an external type as shown, for example, in U.S. Pat. No. 1,746,220 entitled Spring Vibration Damper, issued Feb. 4, 1930 to William H. Manning and such spring dmaper can also be either in the form of a flat coil spring or it can be of cup-shape, as shown in the above-identified patents, respectively.

SUMMARY OF THE INVENTION

The present invention relates to an improved valve spring damper for the valve return spring of a valve, the damper being of cup-shaped configuration so as to include a split-ring like portion terminating in a plurality of spaced apart radial load carrying feet, one surface of each foot being adapted to have one end of a valve return spring abut thereagainst, the opposite surface of each foot being provided with a semi-spherical embossment extending from the normal load bearing surface of the foot in order for the foot to accommodate to a support surface that may be normal or inclined relative to the reciprocating axis of the valve.

Accordingly, a primary object of the present invention is to provide an improved spring vibration damper, for use with the valve return spring of a poppet valve, the load support feet means thereof being provided with semi-spherical embossments so that the damper can be used with a support surface that may be normal or inclined relative to the reciprocating axis of the poppet valve.

Another object of the invention is to provide an improved valve spring damper having valve support feet provided with semi-spherical embossments on one surface thereof that are operative to form peen type indentations in an associated support surface, such as a cylinder head or valve rotator to suppress spring or damper rotation relative to the associated support surface.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
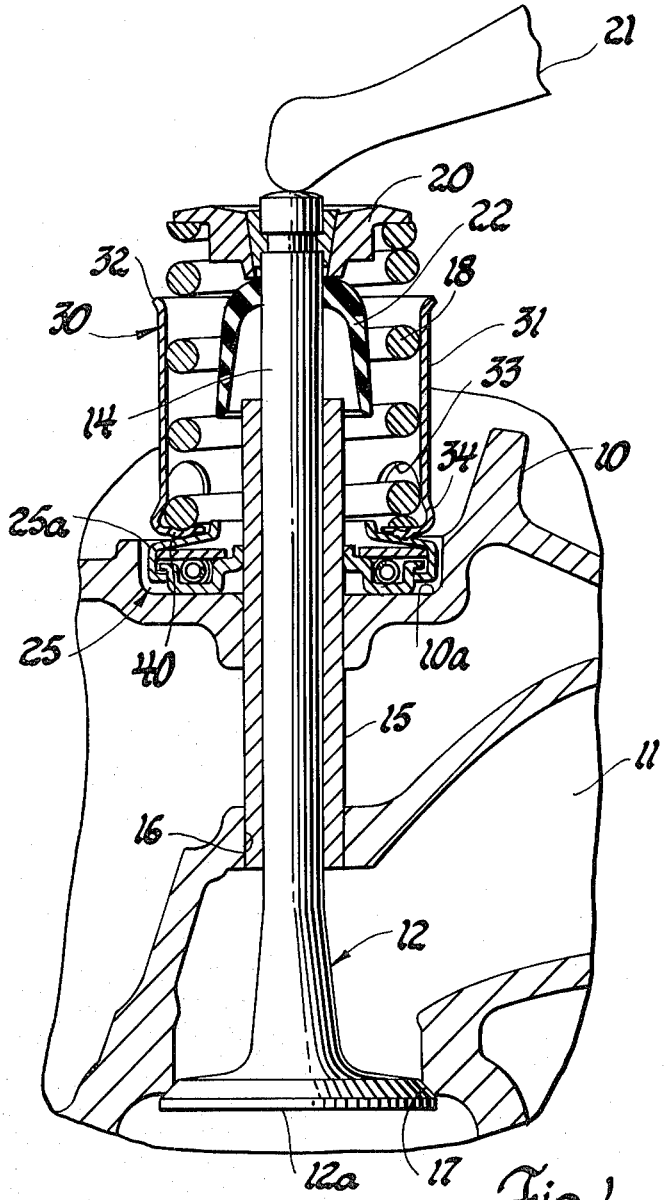
FIG. 1 is a transverse sectional view through a portion of an internal combustion engine showing a valve mechanism with a spring damper, in accordance with the invention, associated therewith.

Referring now to FIG. 1 there is shown a portion of an internal combustion engine of the overhead valve type which includes a cylinder head 10 having a passage 11 therein for flow communication with a combustion cylinder, not shown, the passage 11 being either an induction passage or an exhaust passage, as shown, for the cylinder.

Flow between the passage 11 and the combustion cylinder is controlled by a poppet valve 12, the valve stem 14 of which is slidably guided for axial reciprocation in a valve stem guide 15 that is pressed or otherwise secured in a through bore 16 provided for this purpose in the cylinder head 10 with the upper end of the valve stem 14 projecting above the cylinder head 10.

In a conventional manner, the valve 12 is normally maintained in a closed position, with its head **12*a* seated against an annular valve seat 17, by a valve return spring 18 encircling the upper portion of the stem 14 with one end, the upper end with reference to FIG. 1, of the spring engaging a conventional spring retainer 20 suitably secured to the stem of the poppet valve in a known manner and, its other or lower end operatively engaging the cylinder head 10** in a manner to be described in detail hereinafter.

Opening of the valve 12 is effected in a known manner, as by a rocker arm 21. Also, in the construction shown, a conventional valve stem seal 22 is operatively associated with the valve stem 14.

Figure 3:
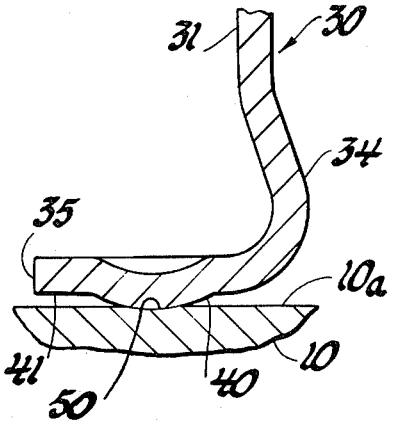
Figure 4:
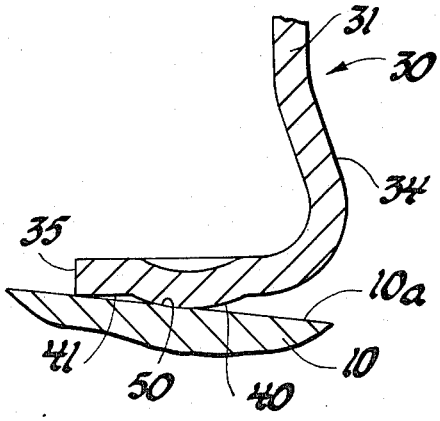

In the embodiment shown, an external type, spring damper 30, in accordance with the invention, is associated with the spring 18 and has a foot means, to be described in detail hereinafter, operatively positioned between the lower end of the spring 18 and a fixed support surface **10*a* of the cylinder head 10, as shown in FIGS. 3 and 4, or, as shown in FIG. 1 with a collar element 25*a* of a conventional valve rotator, generally designated 25, that is operatively sandwiched between the support surface 10*a* and the foot means of the spring damper 30. In the construction shown, the valve rotator 25** is of the type disclosed in U.S. Pat. No. 3,537,325 entitled Valve Rotator, issued Nov. 3, 1970 to Edward Orent, the disclosure of which is incorporated herein by reference thereto.

Figure 2:
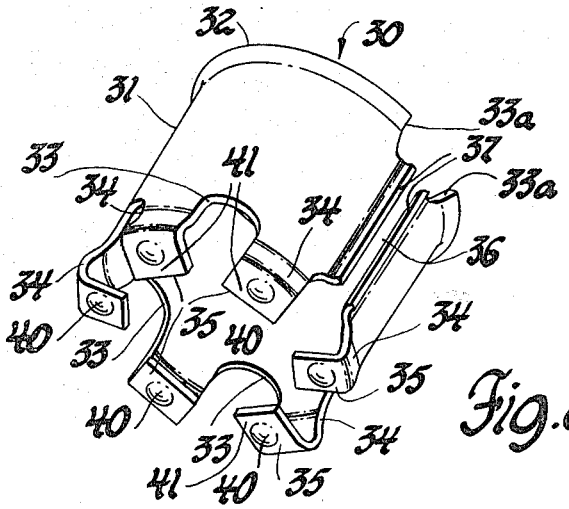
FIG. 2 is a perspective view of the spring damper, per se, of FIG. 1; and, FIGS. 3 and 4 are enlarged schematic sectional views of one of the feet of the damper of FIGS. 1 and 2 resting on support surfaces that are normal and inclined, respectively, relative to the reciprocating axis of the poppet valve shown in FIG. 1.

The spring damper 30, made of a suitable material, such as steel, includes a circular shell that is split-ring like to define a flexable spring envelope or sleeve 31 having a flared lip 32 at its free or upper end and having arcuate pierced openings 33 at its opposite end, as best seen in FIGS. 1 and 2 whereby to provide circumferentially spaced apart return bend portions 34, each of which terminates in a radially inward extending load carrying foot 35. As best seen in FIG. 2, six such equally spaced apart load carrying feet 35 are provided for in the embodiment of the spring damper illustrated.

As best seen in FIG. 2, the circular shell having the longitudinal extending slot 36 therethrough so as to define the split sleeve 31 is also provided at opposite ends with arcuate pierced portions 33*a* on opposite sides of the slot 36 and, the free ends of the sleeve 31, adjacent to the slot 36, are formed to define outwardly flared lips 37. As will be apparent the flared lip 32 and lips 37 are provided whereby to facilitate assembly of the spring damper 30 to an associate valve return spring 18.

Since in the construction shown the spring damper 30 is of an external type, the nominal inside diameter of its sleeve 31 is preselected relative to the nominal outside working diameter of the coils of the valve return spring 18 whereby the sleeve 31 frictionally engages the coils of the spring so that the spring damper is operative to yieldingly resist any tendency for the valve return spring 18 to buckle or deform laterally.

With this arrangement, the frictional contact between the sleeve 31 and the coils of the valve return spring 18 is such as to restrict movement of the coils, as desired, whereby vibratory reactions during movement of the spring are damped out and the tendency toward spring surge and the build up of vibratory periods are substantially eliminated.

Also, since the spring damper 30 is of an external type, the radial inward extent of the feet 35 is preselected relative to the nominal inside diameter of the coils of the valve return spring 18 so as to permit the bottom coil of this spring to abut thereagainst, as shown in FIG. 1.

Now in accordance with a feature of the invention, each foot 35 of the spring damper 30 is provided with a semi-spherical embossment 40 extending from the approximate center of what would otherwise be the normal load bearing surface 41 of the foot. The embossment 40 on each of the feet 35 is of a predetermined radius, as desired, whereby these embossments 40 allow the feet 35 to accommodate to flat or tilted support surfaces, that is, to support surfaces that are either normal to or slightly inclined relative to the reciprocating axis of the associate poppet valve 12.

As is well known in the art, the support surface can be either a machined surface 10*a* provided on a cylinder head 10 at a location concentric with the reciprocating axis of the poppet valve 12 or, as shown in FIG. 1, the support surface can be provided by the upper inclined surface of a washer-like element 25*a*, which in the construction shown, is a collar element of a conventional valve rotator 25 that is sandwiched between the feet 35 and an associate fixed support surface 10*a* on the cylinder head 10.

Thus as shown in FIGS. 1, 3 and 4, each foot 35 has the valve return spring 18 load thereon transmitted via its embossment 40 to an associate support surface, which may be normal relative to the reciprocating axis of an associate valve as shown in FIG. 3, or which support surface may be inclined, within limits as defined by the radius of the embossments, relative to this reciprocating axis as shown in FIGS. 1 and 4, respectively.

The embossments 40, in addition to allowing the feet 35 to accommodate to support surfaces that may be normal or inclined relative to the reciprocating axis of an associate valve 12, are also operative to put a peen type indentation 50 in the associate support surface, such as the support surfaces 10*a*, as shown in FIGS. 3 and 4. The embossments 40, as thus partly engaged in these indentations 50 in their associate support surface will be operative to substantially prevent undesirable rotation of the spring damper 30 relative to the associate support surface, whether the support surface is on the cylinder head 10, as shown in FIGS. 3 and 4, or on a valve rotator element 25*a*, as shown in FIG. 1.

While the invention has been described with reference to the structure disclosed herein, it is not confined to the specific details set forth, since it is apparent that modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. In an internal combustion engine having a cylinder head, a poppet valve supported by the cylinder head for movement between valve open and valve closed positions, the poppet valve having a stem extending through a guide bore in the cyliner head, actuator means operatively associated with the poppet valve for reciprocating the poppet valve, the actuator means including a valve return spring loosely encircling the stem of the valve and operatively associated at one end with the stem of the valve for normally biasing the poppet valve to the closed position and, a valve spring damper positioned in thrust transmitting relation between the opposite end of the valve return spring and a support surface of the cylinder head, said valve spring damper including a split-ring like spring envelope encircling said valve return spring and terminating in a plurality of spaced apart radially inward extending load carrying feet, one surface of each of said feet abutting against the opposite end of said valve return spring, the load bearing opposite surface of each of said feet being provided with a semi-sperical embossment extending from the normal load bearing surface of each of said feet in order for each of said feet to accommodate to the support surface on the cylinder head whether the support surface is normal or inclined relative to the reciprocating axis of said poppet valve.

2. In an internal combustion engine having a cylinder head, a poppet valve supported by the cylinder head for movement between valve open and valve closed positions, the poppet valve having a stem extending through a guide bore in the cylinder head, actuator means for reciprocating the poppet valve, the actuator means including a coil valve return spring loosely encircling the stem of the poppet valve and operatively associated at one end thereof for normally biasing the poppet valve to the closed position and, a valve spring damper positioned in thrust transmitting relation between the opposite end of said valve return spring and a fixed support surface on said cylinder head, said valve spring damper including a split-ring like spring envelope frictionally engaging the coils of said valve return spring and terminating in a plurality of spaced apart radially extending load carrying feet, one surface of each of said feet abutting against the opposite end of said valve return spring, the opposite load bearing surface of each said feet being provided with a semi-spherical embossment extending from the normal load bearing surface of the respective foot in order for each of said feet to accommodate to said fixed support surface of the cylinder head whether the support surface is normal or inclined relative to the reciprocating axis of said poppet valve and which embossment, under the force of said valve return spring, are operative to form peen type identations in said support surface which cooperate with the embossments to substantially prevent rotation of said spring damper relative to said support surface.

* * * * *